US010577704B2

(12) United States Patent
Furukawa

(10) Patent No.: US 10,577,704 B2
(45) Date of Patent: Mar. 3, 2020

(54) ELECTROLYTIC HARD GOLD PLATING SOLUTION SUBSTITUTION INHIBITOR AND ELECTROLYTIC HARD GOLD PLATING SOLUTION INCLUDING SAME

(71) Applicant: METALOR TECHNOLOGIES CORPORATION, Tokyo (JP)

(72) Inventor: Masato Furukawa, Numazu (JP)

(73) Assignee: METALOR TECHNOLOGIES CORPORATION, Tokyo (JP)

( * ) Notice: Subject to any disclaimer, the term of this patent is extended or adjusted under 35 U.S.C. 154(b) by 50 days.

(21) Appl. No.: 15/738,398

(22) PCT Filed: Jun. 1, 2016

(86) PCT No.: PCT/JP2016/066152
§ 371 (c)(1),
(2) Date: Dec. 20, 2017

(87) PCT Pub. No.: WO2016/208340
PCT Pub. Date: Dec. 29, 2016

(65) Prior Publication Data

US 2018/0187321 A1 Jul. 5, 2018

(30) Foreign Application Priority Data

Jun. 26, 2015 (JP) ..... 2015-129063

(51) Int. Cl.
*C25D 3/48* (2006.01)
*C25D 3/62* (2006.01)

(52) U.S. Cl.
CPC ..... *C25D 3/62* (2013.01)

(58) Field of Classification Search
CPC ..... C25D 3/48
USPC ..... 205/267, 268
See application file for complete search history.

(56) References Cited

U.S. PATENT DOCUMENTS

| | | | | |
|---|---|---|---|---|
| 7,261,803 | B2 * | 8/2007 | Abe | C25D 3/48 205/266 |
| 8,048,284 | B2 | 11/2011 | Reddington et al. | |
| 8,337,688 | B2 | 12/2012 | Reddington et al. | |
| 8,608,931 | B2 | 12/2013 | Zhang-Beglinger et al. | |
| 2004/0069641 | A1 | 4/2004 | Abe et al. | |
| 2004/0195107 | A1 * | 10/2004 | Chalumeau | C25D 3/48 205/247 |
| 2005/0153059 | A1 * | 7/2005 | Wakizaka | C23C 18/2006 427/96.1 |
| 2007/0029206 | A1 | 2/2007 | Abe et al. | |
| 2008/0269395 | A1 | 10/2008 | Reddington et al. | |
| 2011/0147220 | A1 | 6/2011 | Zhang-Beglinger et al. | |
| 2012/0034371 | A1 | 2/2012 | Reddington et al. | |
| 2017/0159195 | A1 * | 6/2017 | Breitfelder | C25D 3/48 |

FOREIGN PATENT DOCUMENTS

| | | | |
|---|---|---|---|
| CN | 100383278 | C | 7/2005 |
| EP | 2990507 | A | 3/2016 |
| JP | S53-137035 | A | 11/1978 |
| JP | 2529021 | B | 8/1996 |
| JP | 2003-226993 | A | 8/2003 |
| JP | 2003-268586 | A | 9/2003 |
| JP | 2004-176171 | A | 6/2004 |
| JP | 2008-261050 | A | 10/2008 |
| JP | 2010-077527 | A | 4/2010 |
| JP | 2010-122192 | A | 6/2010 |
| JP | 2011-122236 | A | 6/2011 |
| JP | 4719822 | B2 | 7/2011 |
| WO | 2009/150915 | A1 | 12/2009 |

* cited by examiner

*Primary Examiner* — Edna Wong
(74) *Attorney, Agent, or Firm* — Norris McLaughlin, P.A.

(57) ABSTRACT

Electrolytic hard gold plating solution substitution inhibitors containing at least one compound selected from the group consisting of an imidazole compound having a mercapto group, a triazole compound having a mercapto group, and an aliphatic compound having a sulfonic acid group and a mercapto group are provided. Electrolytic hard gold plating solutions containing at least one electrolytic hard gold plating solution substitution inhibitor, a gold salt, a soluble cobalt salt and/or a soluble nickel salt, an organic acid conducting salt, and a chelating agent are also provided.

3 Claims, No Drawings

ELECTROLYTIC HARD GOLD PLATING SOLUTION SUBSTITUTION INHIBITOR AND ELECTROLYTIC HARD GOLD PLATING SOLUTION INCLUDING SAME

TECHNICAL FIELD

The present invention relates to a displacement inhibitor for electrolytic hard gold plating solution and an electrolytic hard gold plating solution containing the same. More specifically, the present invention relates to an electrolytic hard gold plating solution capable of selectively performing gold plating in the process of forming a nickel plating film on a copper-based connector by electrolytic plating and then performing gold plating to form a protective film on the nickel plating film.

BACKGROUND ART

Recent technological advances have led to weight saving, downsizing, and performance improvement of mobile terminals such as smart phones and tablets. These electronic devices use connectors as electric connecting members, and the connectors have gold plating films formed on the surfaces thereof. Gold is very excellent in physical (soft), chemical (very stable), and electric (low resistance) properties, and is therefore widely used not only for connectors but also for other electronic components such as printed circuit boards.

The plating processing of such a connector is performed by applying a nickel coating to a copper-based material and then applying a hard gold plating to the nickel coating. At present, such a hard gold plating is applied to a relatively large portion. However, in recent years, the price of gold has increased, and therefore there has been strong demand for reducing the amount of gold used in a gold plating process to reduce manufacturing costs. That is, there has been demand for establishment of a technique for forming a thin gold plating film only on a portion that needs to be plated. Various measures have been taken against plating apparatuses and gold plating solutions to achieve such a reduction in the amount of gold used.

Plating apparatuses have taken the approach that a gold plating solution is sprayed at a high speed from a minute nozzle only on a portion that needs to be plated with gold or the approach that a plating jig is used which is formed so that a gold plating solution comes into contact only with a portion that needs to be plated with gold.

Gold plating solutions have taken the approach that the concentration of gold in a gold plating solution is reduced to reduce the amount of gold lost by discharging the gold plating solution adhered to an object to be plated into a washing tank used in the next process. However, when the concentration of gold in a gold plating solution is reduced, the stability of a gold complex in a plating bath is reduced due to an increase in a bath voltage. This leads to a problem that gold particles are generated so that gold is deposited on the inner wall of a plating tank.

Patent Literatures 1 to 3 disclose gold plating solutions intended to reduce the amount of gold to be used. Patent Literatures 1 and 2 disclose gold plating solutions intended to inhibit the deposition of gold at a low current density to inhibit so-called plating leakage that is a phenomenon in which when a gold plating solution is sprayed on an object to be plated, a small amount of the gold plating solution comes into contact also with a portion that does not need to be plated with gold so that a plating film is formed on such a portion. Further, Patent Literature 3 discloses a gold plating solution that contains an organic additive so that a uniform gold plating film can be formed while the formation of pinholes is inhibited even when the gold plating film has a small film thickness.

The above-described inventions have considerably advanced the technique of reducing the amount of gold used during gold plating performed by applying an electric current to a gold plating solution. However, there is a case where gold is deposited on a nickel base coat by a displacement reaction even when an electric current is not applied to a gold plating solution before and after the gold plating process, which has become a serious problem in recent years. With an increase in the speed of gold plating, a gold plating solution is sprayed on an object to be plated at a high speed with the use of a pump. At this time, the gold plating solution leaks or splatters so that a mist of the gold plating solution adheres to a nickel-coated portion around a plating jig. This adhered gold plating solution forms a gold plating film on a nickel base coated portion that does not need to be plated with gold. Gold is a noble metal, and therefore has a lower ionization tendency than nickel as a base coat. Therefore, nickel is dissolved into the gold plating solution as nickel ions, and gold in the gold plating solution is deposited as a gold film on the nickel base coat. This deposition of gold caused by a displacement reaction is required to be improved from the viewpoint of quality and cost.

One of measures against this problem is to perform gold removal treatment using a gold remover on the entire surface of an object to be plated after the completion of gold plating. A gold plating film formed on a portion to be plated and a gold plating film formed on a portion that does not need to be plated are different in film thickness. Therefore, gold removal treatment is slightly performed on the entire surface of the object to be plated so that the gold plating film formed on a portion that does not need to be plated can be completely removed while the gold plating film formed on a portion to be plated is left so as to have a predetermined film thickness.

However, the thicknesses of gold films have been reduced in recent years, and therefore a difference in film thickness between a gold plating film formed on a portion to be plated and a gold plating film formed on a portion that does not need to be plated has become smaller. Therefore, in some cases, such gold removal treatment using a gold remover is not sufficiently effective.

Patent Literature 4 discloses an agent for inhibiting gold displacement/electric corrosion, and the agent contains a mercapto compound. The mercapto compound has the effect of inhibiting displacement in the initial state, but a decomposition product generated during running reduces the effect of inhibiting displacement.

CITATION LIST

Patent Literatures

Patent Literature 1: JP 2010-077527 A
Patent Literature 2: JP 4719822 B1
Patent Literature 3: JP 2010-122192 A
Patent Literature 4: JP 2529021 B1

SUMMARY OF INVENTION

Technical Problem

It is an object of the present invention to provide a displacement inhibitor for electrolytic hard gold plating solution capable of inhibiting the deposition of gold in a plating bath and minimizing a displacement reaction with a nickel base coat of a portion other than a portion to be plated, and an electrolytic hard gold plating solution that contains the displacement inhibitor to have excellent plating selectivity.

Solution to Problem

The present inventors have intensively studied to achieve the above object, and as a result have found that addition of a predetermined organic displacement inhibitor to a gold plating solution makes it possible to form a protective film on a nickel base coat in a state where no electric current is applied to the gold plating solution and to easily remove the protective film by the application of an electric current to the gold plating solution. Further, the present inventors have found that the presence of the protective film formed on the nickel base coat makes it possible to perform selective plating without causing a displacement reaction with the nickel base coat even when the gold plating solution comes into contact with the nickel base coat in a state where no electric current is applied. Further, the present inventors have found that the deposition of gold on the inner wall of a plating bath resulting from the generation of gold particles can also be inhibited because a displacement reaction with the nickel base coat does not occur. These findings have led to the completion of the present invention.

More specifically, in order to achieve the above object, the present invention includes the following aspects.

[1] A displacement inhibitor for electrolytic hard gold plating solution, comprising at least one compound selected from the group consisting of an imidazole compound having a mercapto group, a triazole compound having a mercapto group, and an aliphatic compound having a sulfonate group and a mercapto group.

[2] An electrolytic hard gold plating solution comprising:

a gold salt;

a soluble cobalt salt and/or a soluble nickel salt;

an organic acid conductive salt;

a chelating agent; and the displacement inhibitor for electrolytic hard gold plating solution according to [1].

[3] The electrolytic hard gold plating solution according to [2], wherein the gold salt is a gold cyanide salt.

[4] The electrolytic hard gold plating solution according to [2], wherein the chelating agent is at least one selected from the group consisting of a carboxylic acid, an oxycarboxylic acid, and salts thereof.

[5] The electrolytic hard gold plating solution according to [2] whose pH (25° C.) is in a range of 3 to 7.

Advantageous Effects of Invention

The electrolytic hard gold plating solution according to the present invention is optimum for gold plating processing of a connector or the like that needs to be selectively plated, because it is possible to inhibit the deposition of gold in a plating bath and the occurrence of a gold displacement reaction on a nickel base coat in a portion other than a portion to be plated.

DESCRIPTION OF EMBODIMENTS

Hereinbelow, a displacement inhibitor for electrolytic hard gold plating solution according to the present invention and an electrolytic hard gold plating solution containing the same will be described in detail.

The displacement inhibitor for electrolytic hard gold plating solution according to the present invention comprises at least one compound selected from the group consisting of an imidazole compound having a mercapto group, a triazole compound having a mercapto group, and an aliphatic compound having a sulfonate group and a mercapto group.

Examples of the imidazole compound having a mercapto group include 2-mercaptobenzimidazole, 2-mercapto-1-methylimidazole, 5-amino-2-mercaptobenzimidazole, 2-mercapto-5-methylbenzimidazole, 5-chloro-2-mercaptobenzimidazole, 2-mercapto-5-benzimidazolecarboxylic acid, 5-ethoxy-2-mercaptobenzimidazole, 2-mercapto-5-methoxybenzimidazole, 2-mercapto-5-benzimidazolesulfonic acid, 2-mercapto-5-nitrobenzimidazole, and salts thereof.

Examples of the triazole compound having a mercapto group include 3-mercapto-1,2,4-triazole, 3-amino-5-mercapto-1,2,4-triazole, and salts thereof.

Examples of the aliphatic compound having a sulfonate group and a mercapto group include 3-mercapto-1-propanesulfonic acid, 2-hydroxy-3-mercapto-1-propanesulfonic acid, and salts thereof.

The amount of such a displacement inhibitor to be added to an electrolytic hard gold plating solution is usually 0.01 to 5 g/L, preferably 0.05 to 2 g/L. If the amount of the displacement inhibitor to be added is less than 0.01 g/L, the effect of inhibiting displacement cannot sufficiently be obtained, and a large amount of gold is deposited by displacement on a nickel base coat in a portion other than a portion to be plated. Even if the amount of the displacement inhibitor to be added exceeds 5 g/L, an effect obtained by adding the displacement inhibitor does not increase in proportion to the amount of the displacement inhibitor added, which is not economical.

The electrolytic hard gold plating solution according to the present invention comprises a gold salt, a soluble cobalt salt and/or a soluble nickel salt, an organic acid conductive salt, a chelating agent, and the above-described displacement inhibitor for electrolytic hard gold plating solution.

The electrolytic hard gold plating solution according to the present invention contains, as an organic displacement inhibitor, at least one compound selected from the group consisting of an imidazole compound having a mercapto group, a triazole compound having a mercapto group, and an aliphatic compound having a sulfonate group and a mercapto group. This organic displacement inhibitor forms a thin protective film on a nickel base coat before and after electrolytic plating processing (i.e., in a state where no electric current is applied to the gold plating solution) to inhibit a gold displacement reaction. Further, this protective film is easily removed during electrolytic plating processing (i.e., in a state where an electric current is applied to the gold plating solution). Therefore, a normal gold plating film can be obtained without adverse effects on the appearance of gold plating, deposition rate, etc. Such an action allows the electrolytic hard gold plating solution according to the present invention containing an organic displacement inhibitor to inhibit a gold displacement reaction with a nickel base coat in a portion other than a portion to be plated.

As the gold salt, a gold cyanide compound is used.

Examples of the gold cyanide compound include gold potassium cyanide, gold sodium cyanide, and gold ammonium cyanide. The gold ion concentration of the electrolytic hard gold plating solution according to the present invention is 0.1 to 20 g/L, preferably 2 to 15 g/L. If the gold ion concentration is less than 0.1 g/L, cathode current efficiency is too low to achieve a predetermined gold film thickness. If the gold ion concentration exceeds 20 g/L, cathode current efficiency does not increase in proportion to the gold ion concentration. Further, the amount of gold metal to be lost by taking out of the plating solution is large, which is not economical.

The electrolytic hard gold plating solution according to the present invention contains a soluble cobalt salt and/or a soluble nickel salt. Examples of the cobalt salt include cobalt sulfate, cobalt nitrate, cobalt chloride, and basic cobalt carbonate. Examples of the nickel salt include general nickel sulfate, nickel sulfamate, nickel sulfite, and nickel chloride. These salts may be added singly or in combination of two or more of them. The concentration of the cobalt salt and the nickel salt in the electrolytic hard gold plating solution according to the present invention is 0.01 to 10 g/L, preferably 0.1 to 1.0 g/L. If the concentration is less than 0.01 g/L, film hardness is not increased, and therefore a resulting hard gold film cannot have desired properties. Even if the concentration exceeds 10 g/L, an effect obtained by adding the cobalt salt and the nickel salt does not increase in proportion to the concentration, which is not economical. It is to be noted that the term "soluble" in the soluble cobalt salt and the soluble nickel salt contained in the electrolytic hard gold plating solution according to the present invention means that the gold plating solution can contain them at the above concentration.

The electrolytic hard gold plating solution according to the present invention contains an organic acid conductive salt. Examples of the organic acid conductive salt include potassium citrate, potassium phosphate, potassium nitrate, potassium succinate. These organic acid conductive salts may be added singly or in combination of two or more of them. The concentration of the organic acid conductive salt in the electrolytic hard gold plating solution according to the present invention is 10 to 200 g/L, preferably 50 to 100 g/L. If the concentration is less than 10 g/L, a normal gold film cannot be obtained due to the deterioration of appearance. Even if the concentration exceeds 200 g/L, an effect obtained by adding the organic acid conductive salt does not increase in proportion to the concentration, which is not economical.

As the chelating agent, a carboxylic acid or a salt thereof or an oxycarboxylic acid or a salt thereof is used. Examples of the chelating agent include formic acid, glycolic acid, lactic acid, oxybenzoic acid, oxalic acid, malonic acid, succinic acid, malic acid, tartaric acid, phthalic acid, diglycolic acid, citric acid, and salts thereof. The concentration of the chelating agent in the electrolytic hard gold plating solution according to the present invention is 1 to 50 g/L, preferably 5 to 20 g/L. If the concentration is less than 1 g/L, inorganic impurities are incorporated into a resulting gold film, which deteriorates the appearance and properties of the gold film. Even if the concentration exceeds 50 g/L, an effect obtained by adding the chelating agent does not increase in proportion to the concentration, which is not economical.

The electrolytic hard gold plating solution according to the present invention can be used at a pH (25° C.) of 3.0 to 7.0, but is preferably used at a pH of 4.0 to 5.0. If the pH is lower than 3.0, cathode current efficiency is too low to achieve a predetermined gold film thickness. If the pH is higher than 7.0, a gold film having a reddish appearance is obtained, which is not a normal gold film. It is to be noted that as a pH adjusting agent, sodium hydroxide, potassium hydroxide, ammonium hydroxide, diluted sulfuric acid water, or the like is used.

The electrolytic hard gold plating solution according to the present invention can be used at a liquid temperature of 20 to 90° C., but is preferably used at 40 to 70° C. If the liquid temperature of the plating solution is lower than 20° C., cathode current efficiency is too low to achieve a predetermined gold film thickness. Even if the liquid temperature of the plating solution is higher than 90° C., an effect obtained by increasing the liquid temperature does not increase in proportion to the temperature, which is not economical.

EXAMPLES

Hereinbelow, the present invention will be described in more detail with reference to examples, but is not limited to these examples. The configuration of a device used for a test and the method of evaluation are as follows.

The effect of inhibiting displacement was evaluated using, as a sample, a substrate obtained by coating a copper plate with a nickel sulfamate film having a film thickness of 2 μm.

A silicon sheet having an opening of 10 mm×10 mm was attached to an acrylic mask plate having an opening of 10 mm×10 mm, and the sample was placed on the silicon sheet. The sample was fixed by holding down the sample from above with a hold block covered with a silicon sheet. A gold plating solution was circulated with a pump and sprayed onto the sample from the bottom for 10 minutes through a platinum nozzle having a diameter of 5 mm. In order to evaluate the film thickness of a gold film formed on the nickel base coat by a gold displacement reaction, no electric current was applied to the plating solution. A gold film was formed by displacement on the surface of the sample in the form of the 10 mm×10 mm opening of the mask, and the film thickness of the gold film was measured in five positions on the diagonal line of the gold film with the use of a fluorescent X-ray film thickness meter SEA5120 manufactured by SII.

The effect of inhibiting the deposition of gold in a plating bath was evaluated using, as a sample, a 3 cm×1 cm piece cut out from a silicon wafer subjected to gold sputtering.

A glass container with lid having a capacity of 20 ml was filled with a plating solution, the sample was immersed in the plating solution, and the glass container was placed in a drier with the lid being closed and allowed to stand at 70° C. for 36 hours. The deposition of gold in a bath is electroless deposition on gold particles, and therefore the effect of inhibiting the deposition of gold can be evaluated by measuring a gold film thickness before and after immersion of the sample subjected to gold sputtering. The gold film thickness was measured in five positions in the center of the sample with the use of a fluorescent X-ray film thickness meter SEA5120 manufactured by SII in the same manner as in the evaluation of effect of inhibiting displacement.

Comparative Example 1

Potassium gold cyanide: 5 g/L (as Au)
Potassium citrate: 120 g/L
Potassium formate: 20 g/L
Cobalt sulfate: 0.96 g/L A plating solution containing the above components was adjusted to pH 4.2, and sprayed onto a sample at a liquid temperature of 55° C. for 10 minutes. A gold film formed by displacement deposition had a film thickness of 0.100 μm.

A sample was immersed in the same plating solution as described above at 70° C. for 36 hours. A gold film formed by electroless deposition had a film thickness of 0.270 μm.

Further, a normal gold plating film was obtained at a current density of 10 to 60 A/dm$^2$.

Comparative Example 2

Potassium gold cyanide: 5 g/L (as Au)
Potassium citrate: 120 g/L
Potassium formate: 20 g/L
Cobalt sulfate: 0.96 g/L
2-Aminobenzimidazole: 0.1 g/L A plating solution containing the above components was adjusted to pH 4.2, and sprayed onto a sample at a liquid temperature of 55° C. for 10 minutes. A gold film formed by displacement deposition had a film thickness of 0.950 μm.

A sample was immersed in the same plating solution as described above at 70° C. for 36 hours. A gold film formed by electroless deposition had a film thickness of 0.230 μm.

Further, a normal gold plating film was obtained at a current density of 10 to 60 A/dm$^2$.

Comparative Example 3

Potassium gold cyanide: 5 g/L (as Au)
Potassium citrate: 120 g/L
Potassium formate: 20 g/L
Cobalt sulfate: 0.96 g/L
1,2,3-Benzotriazole: 0.1 g/L A plating solution containing the above components was adjusted to pH 4.2, and sprayed onto a sample at a liquid temperature of 55° C. for 10 minutes. A gold film formed by displacement deposition had a film thickness of 0.965 μm.

A sample was immersed in the same plating solution as described above at 70° C. for 36 hours. A gold film formed by electroless deposition had a film thickness of 0.251 μm.

Further, a normal gold plating film was obtained at a current density of 10 to 60 A/dm$^2$.

Example 1

Potassium gold cyanide: 5 g/L (as Au)
Potassium citrate: 120 g/L
Potassium formate: 20 g/L
Cobalt sulfate: 0.96 g/L
2-Mercaptobenzimidazole: 0.1 g/L A plating solution containing the above components was adjusted to pH 4.2, and sprayed onto a sample at a liquid temperature of 55° C. for 10 minutes. A gold film formed by displacement deposition had a film thickness of 0.001 μm, and therefore a gold displacement reaction could be significantly inhibited.

A sample was immersed in the same plating solution as described above at 70° C. for 36 hours. A gold film formed by electroless deposition had a film thickness of 0.049 μm, and therefore deposition could be inhibited.

Further, a normal gold plating film was obtained at a current density of 10 to 60 A/dm$^2$.

Example 2

Potassium gold cyanide: 5 g/L (as Au)
Potassium citrate: 120 g/L
Potassium formate: 20 g/L
Cobalt sulfate: 0.96 g/L
2-Mercapto-1-methylimidazole: 0.1 g/L A plating solution containing the above components was adjusted to pH 4.2, and sprayed onto a sample at a liquid temperature of 55° C. for 10 minutes. A gold film formed by displacement deposition had a film thickness of 0.001 μm, and therefore a gold displacement reaction could be significantly inhibited.

A sample was immersed in the same plating solution as described above at 70° C. for 36 hours. A gold film formed by electroless deposition had a film thickness of 0.051 μm, and therefore deposition could be inhibited.

Further, a normal gold plating film was obtained at a current density of 10 to 60 A/dm$^2$.

Example 3

Potassium gold cyanide: 5 g/L (as Au)
Potassium citrate: 120 g/L
Potassium formate: 20 g/L
Cobalt sulfate: 0.96 g/L
3-Mercapto-1,2,4-triazole: 0.1 g/L A plating solution containing the above components was adjusted to pH 4.2, and sprayed onto a sample at a liquid temperature of 55° C. for 10 minutes. A gold film formed by displacement deposition had a film thickness of 0.001 μm, and therefore a gold displacement reaction could be significantly inhibited.

A sample was immersed in the same plating solution as described above at 70° C. for 36 hours. A gold film formed by electroless deposition had a film thickness of 0.051 μm, and therefore deposition could be inhibited.

Further, a normal gold plating film was obtained at a current density of 10 to 60 A/dm$^2$.

Example 4

Potassium gold cyanide: 5 g/L (as Au)
Potassium citrate: 120 g/L
Potassium formate: 20 g/L
Cobalt sulfate: 0.96 g/L
2-Mercapto-1-propanesulfonic acid: 0.1 g/L A plating solution containing the above components was adjusted to pH 4.2, and sprayed onto a sample at a liquid temperature of 55° C. for 10 minutes. A gold film formed by displacement deposition had a film thickness of 0.001 μm, and therefore a gold displacement reaction could be significantly inhibited.

A sample was immersed in the same plating solution as described above at 70° C. for 36 hours. A gold film formed by electroless deposition had a film thickness of 0.059 μm, and therefore deposition could be inhibited.

Further, a normal gold plating film was obtained at a current density of 10 to 60 A/dm$^2$.

Example 5

Potassium gold cyanide: 5 g/L (as Au)
Potassium citrate: 120 g/L
Potassium formate: 20 g/L
Cobalt sulfate: 0.96 g/L
2-Hydroxy-3-mercapto-1-propanesulfonic acid: 0.1 g/L A plating solution containing the above components was adjusted to pH 4.2, and sprayed onto a sample at a liquid temperature of 55° C. for 10 minutes. A gold film formed by displacement deposition had a film thickness of 0.001 μm, and therefore a gold displacement reaction could be significantly inhibited.

A sample was immersed in the same plating solution as described above at 70° C. for 36 hours. A gold film formed by electroless deposition had a film thickness of 0.060 μm, and therefore deposition could be inhibited.

Further, a normal gold plating film was obtained at a current density of 10 to 60 $A/dm^2$.

The invention claimed is:

1. An electrolytic hard gold plating solution comprising:

0.1 to 20 g/L of a gold cyanide salt;

0.01 to 10 g/L of a soluble cobalt salt and/or a soluble nickel salt;

10 to 200 g/L of an organic acid conductive salt;

1 to 50 g/L of a chelating agent; and 0.01 to 5 g/L of a displacement inhibitor for electrolytic hard gold plating solution comprising at least one compound selected from the group consisting of an imidazole compound having a mercapto group, 2-mercapto-1-propanesulfonic acid, and 2-hydroxy-3-mercapto-1-propanesulfonic acid.

2. The electrolytic hard gold plating solution according to claim 1, wherein the chelating agent is at least one selected from the group consisting of a carboxylic acid, an oxycarboxylic acid, and salts thereof.

3. The electrolytic hard gold plating solution according to claim 1 whose pH at 25° C. is in a range of 3 to 7.

* * * * *